US008195064B2

(12) United States Patent
Dickerson et al.

(10) Patent No.: US 8,195,064 B2
(45) **Date of Patent: *Jun. 5, 2012**

(54) SEPARATOR HANGER FOR ENABLING CONSTRAINED POSITIONING OF A PACKAGING FABRIC INSERT IN AN IMAGE FORMING DEVICE

(75) Inventors: James Eric Dickerson, Lexington, KY (US); Alfred Louis Fahmy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/159,779

(22) Filed: Jun. 14, 2011

(65) Prior Publication Data

US 2011/0244174 A1 Oct. 6, 2011

Related U.S. Application Data

(63) Continuation of application No. 12/178,171, filed on Jul. 23, 2008, now Pat. No. 7,983,595.

(51) Int. Cl.

| | |
|---|---|
| ***G03G 15/00*** | (2006.01) |
| ***G03G 21/00*** | (2006.01) |
| ***G03G 15/08*** | (2006.01) |
| ***G03G 21/18*** | (2006.01) |

(52) U.S. Cl. ..... 399/110; 399/98; 399/103; 399/114

(58) Field of Classification Search ..... 399/91, 399/98, 99, 111, 114, 119, 102, 103, 110; 248/300; 206/461, 467, 593

See application file for complete search history.

(56) References Cited

U.S. PATENT DOCUMENTS

| | | | | |
|---|---|---|---|---|
| 5,218,410 | A | 6/1993 | Nakabayashi et al. | |
| 5,227,844 | A | 7/1993 | Bhattacharjee et al. | |
| 5,339,958 | A * | 8/1994 | Taravella et al. | 206/593 |
| 5,749,026 | A | 5/1998 | Goldie | |
| 5,920,753 | A | 7/1999 | Sasaki et al. | |
| 5,946,520 | A | 8/1999 | Hooper et al. | |
| 5,974,287 | A | 10/1999 | Kurz et al. | |
| 6,009,287 | A | 12/1999 | Goldie | |
| 6,101,348 | A | 8/2000 | Nonaka et al. | |
| 6,317,573 | B1 | 11/2001 | Baker et al. | |
| 6,681,089 | B2 | 1/2004 | Dougherty | |
| 6,845,225 | B2 | 1/2005 | Toyoda et al. | |
| 6,978,100 | B2 | 12/2005 | Yasui et al. | |
| 7,155,137 | B2 | 12/2006 | Yasui et al. | |
| 7,248,812 | B2 | 7/2007 | Tombs | |
| 7,983,595 | B2 * | 7/2011 | Dickerson et al. | 399/110 |
| 2008/0038009 | A1 | 2/2008 | Bracken et al. | |

* cited by examiner

*Primary Examiner* — Sandra Brase

(74) *Attorney, Agent, or Firm* — John Victor Pezdek; Justin M Tromp

(57) ABSTRACT

A separator hanger has a body with forward and rearward portions and a central portion interconnecting the forward and rearward portions. The rearward portion has side wing sections extending laterally in opposite directions beyond opposite side edges of the central portion with respective elements thereon adapted to extend through first slots in a packaging insert. The rearward portion also has a tail section between the side wing sections with an element thereon adapted to extend through a second slot in the packaging insert located between and offset from the first slots. Such elements provide the rearward portion in a threaded relationship with the packaging insert so as to detachably attach the rearward portion thereto. The forward portion is adapted to anchor the body to one portion of a device so as to thereby constrain the packaging insert to a position clear of another portion of the device located nearby the packaging insert.

5 Claims, 3 Drawing Sheets

SEPARATOR HANGER FOR ENABLING CONSTRAINED POSITIONING OF A PACKAGING FABRIC INSERT IN AN IMAGE FORMING DEVICE

CROSS REFERENCE TO RELATED APPLICATIONS

This application is a continuation application of parent application Ser. No. 12/178,171, filed Jul. 23, 2008 now U.S. Pat. No. 7,983,595, entitled "Separator Hanger for Enabling Constrained Positioning of a Packaging Fabric Insert in an Image Forming Device." This patent application is related to the following U.S. patent application assigned to the assignee of the present invention: Ser. No. 11/461,819 filed Aug. 2, 2006, entitled "Device and Method for Removing Image Forming Substance Deposits". The disclosure of this application is hereby incorporated herein by reference.

BACKGROUND

1. Field of the Invention

The present invention relates generally to packaging of an image forming apparatus for handling and shipment and, more particularly, to a separator hanger for enabling constrained positioning of a packaging fabric insert in the image forming apparatus.

2. Description of the Related Art

A particular fabric insert has been found useful as a packaging material in preparing an image forming apparatus, such as an electrophotographic device or the like, for handling and shipment to an end-user. This insert is placed between a doctor blade and developer roll of the device to prevent handling and shipping problems due to toner fusing in the nip of these components. This insert and its method of use are disclosed in detail in the patent application cross-referenced above.

Although this packaging fabric insert has provided a satisfactory solution to the handling and shipping problems for which it was designed, several unintended and undesired side-effects have been noted. First, in its normal intended position of use, the insert may inadvertently touch a photoconductor drum of the device. The photoconductor (pc) drum is highly sensitive to its chemical environment and is easily damaged by foreign objects. It is unfortunate that a key step in the process for manufacturing the fabric material requires the use of silicone oil. Portions of the silicone oil retained in the insert after the manufacturing process may seep out later onto the surface of the photoconductor drum, crazing the drum surface and causing various defects on pages later printed by the drum. Second, the insert being in essence a packaging fabric material useful only during handling and shipping of the device naturally then requires removal by the end-user before a toner cartridge can be installed and used. If the insert is not removed, it may inadvertently fall into the end-user's printer and may cause damage.

Thus, there is still a need for an innovation that will overcome these additional problems without introducing any new unintended, undesirable side-effects.

SUMMARY OF THE INVENTION

The present invention meets this need by providing an innovation that will prevent the packaging fabric insert from touching the photoconductive drum as well as make the insert easy to remove and also make it readily apparent to the end-user that the insert needs to be removed in order to be able to install the toner cartridge. The innovation is a relatively simple separator hanger that provides an elegant solution to these problems and does not introduce any new unintended, undesirable side-effects in place thereof.

Accordingly, in an aspect of the present invention, a separator hanger includes a body having forward and rearward portions and a central portion extending between and interconnecting the forward and rearward portions, the central portion having opposite side edges extending between the forward and rearward portions. The rearward portion of the body includes a pair of side wing sections extending laterally in opposite directions with respect to one another and respectively beyond the opposite side edges of the central portion, the side wing sections having respective elements adapted to extend through respective first slots in a packaging insert. The rearward portion of the body also includes a tail section disposed between the side wing sections and having an element adapted to extend through a second slot in the packaging insert located between and offset from the first slots in the packaging insert such that the elements of the tail and side wing sections respectively provide the rearward portion of the body in a threaded relationship with the packaging insert so as to detachably attach the rearward portion of the body to the packaging insert. The forward portion of the body is adapted to anchor the body to one portion of a device so as to thereby constrain the packaging insert to a position clear of another portion of the device located nearby the packaging insert.

In another aspect of the present invention, the separator hanger includes a body having forward and rearward portions and a central portion extending between and interconnecting the forward and rearward portions, the central portion having opposite side edges extending between the forward and rearward portions. The rearward portion of the body includes sections extending laterally beyond the opposite side edges of the central portion and rearwardly from the central portion to adapt detachably attaching the rearward portion of the body to a packaging insert. The forward portion of the body is adapted to anchor the body to one portion of a device so as to thereby constrain the packaging insert to a position clear of another portion of the device located nearby the packaging insert. The forward portion of the body includes a head connected with the central portion of the body and having rear segments extend laterally in opposite directions with respect to the opposite side edges of the central portion of the body, and a pair of slits between the rear segments and the opposite side edges of the central portion and open solely at respective rear edges of the rear segments adjacent to the opposite side edges of the central portion to enable fitting of the one portion of the device through the slits and thereby anchoring of the head of the forward portion of the body to the one portion of the device.

BRIEF DESCRIPTION OF THE DRAWINGS

Figure 1:
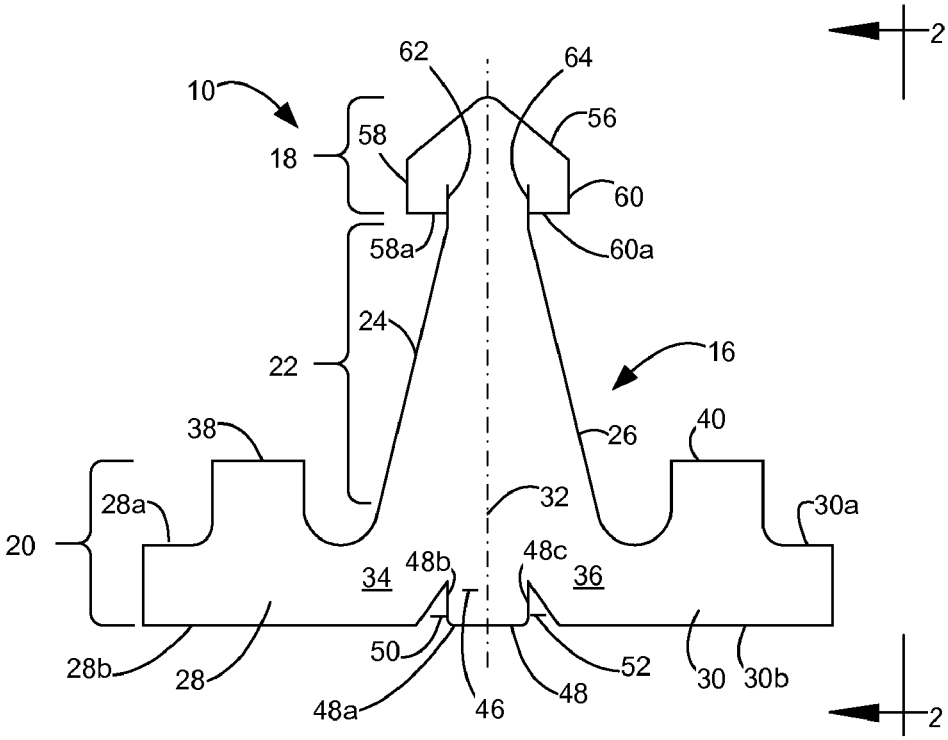
Figure 2:
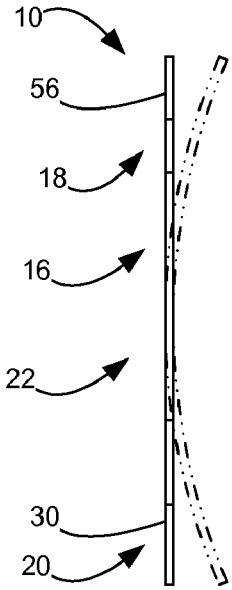
Figure 3:
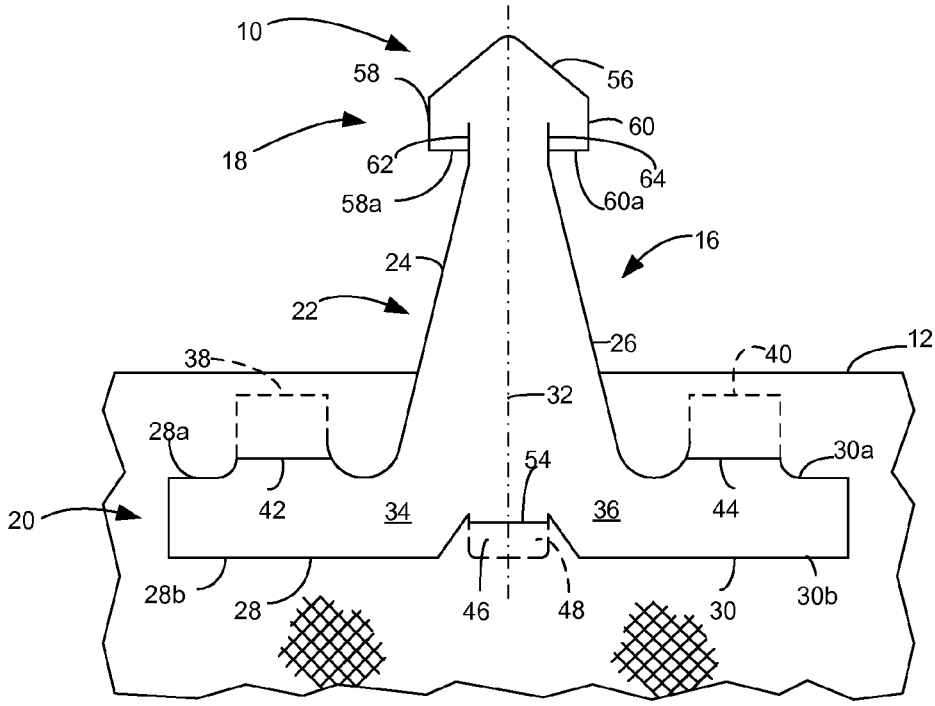
Figure 4:
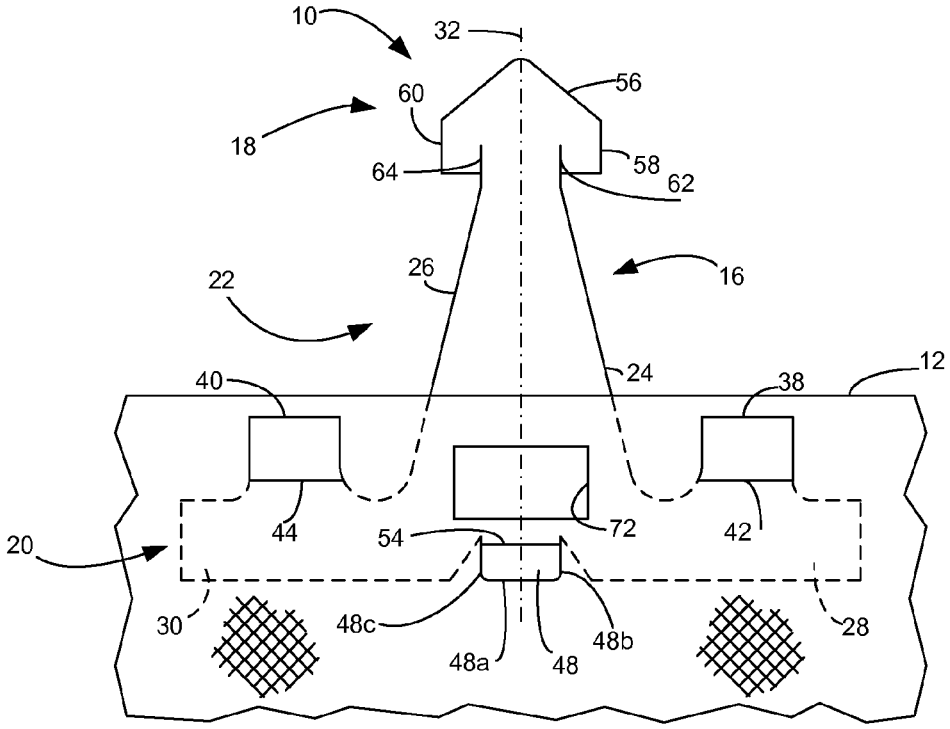
Figure 5:
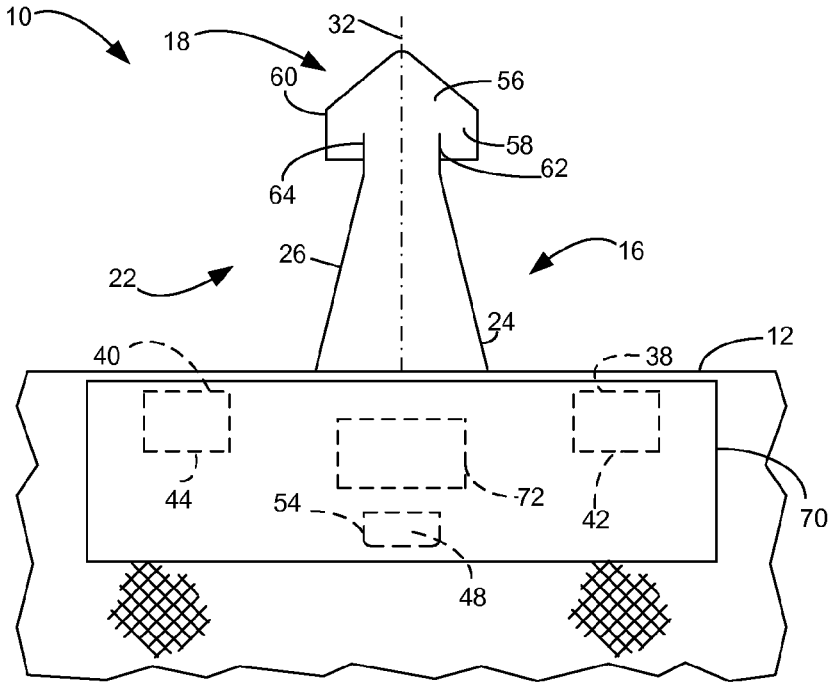
Figure 6:
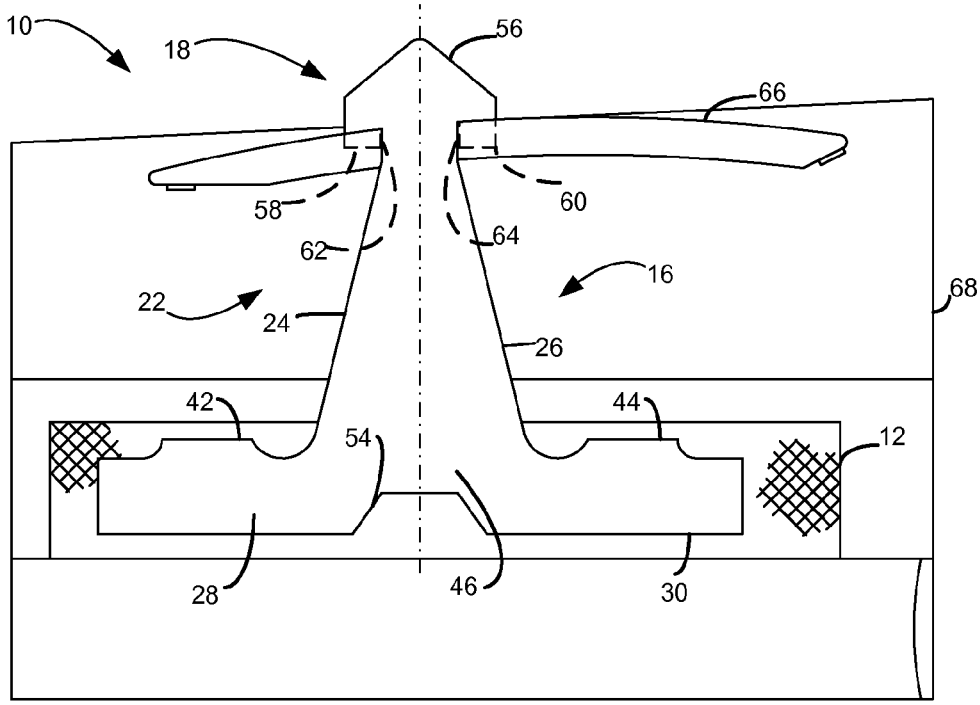

Having thus described the invention in general terms, reference will now be made to the accompanying drawings, which are not necessarily drawn to scale, and wherein:

FIG. 1 is a plan view of an exemplary embodiment of a separator hanger of the present invention;

FIG. 2 is a side view of the hanger as seen along line 2-2 of FIG. 1 also depicting the flexibility of the hanger;

FIG. 3 is a view similar to that of FIG. 1 but now showing the hanger in an assembled orientation with a packaging fabric insert;

FIG. 4 is a view similar to that of FIG. 3 but of a reverse side of the hanger in its assembled orientation with the insert;

FIG. 5 is a view similar to that of FIG. 4 but now showing an adhesive strip bonding the insert to the hanger; and FIG. 6 is a view similar to that of FIG. 3 but now showing the hanger of the present invention detachably anchored to a toner cartridge handle so as to prevent installation of the toner cartridge without first removing the insert and the hanger from an image forming apparatus.

DETAILED DESCRIPTION

The present invention now will be described more fully hereinafter with reference to the accompanying drawings, in which one or more, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views. Also, terms such as "forward", "rearward" and the like are terms of convenience and not to be construed as limiting terms.

Referring now to FIGS. 1-4, there is illustrated an exemplary embodiment of a separator hanger, generally designate 10, of the present invention for enabling constrained positioning of a packaging fabric insert 12 in and removal of the insert 12 from an electrophotographic image forming device 14 (see FIG. 6), or the like, before installation. The separator hanger 10 basically includes a body 16 having forward and rearward portions 18, 20 and a central portion 22 extending between and interconnecting the forward and rearward portions 18, 20. The central portion 22 has opposite side edges 24, 26 extending between the forward and rearward portion 18, 20. By way of example and not limitation, the body 16 may be generally flat such that the forward, rearward and central portions 18-22 share a common planar configuration. Also, the body 16, by way of example and not limitation, may be made of a suitably stiff but flexible, or semi-flexible, plastic material, such as polypropylene or the like, having a suitable thickness, such as, of approximately 1 mm.

More particularly, the rearward portion 20 of the body 16 includes a pair of side wing sections 28, 30. The side wing sections 28, 30 are mirror images of one another relative to a longitudinal axis 32 of the body 16. The side wing sections 28, 30 merge at regions 34, 36 of the body 16 from the central section 22 and extend laterally in opposite directions with respect to one another and beyond the respective opposite side edges 24, 26 of the central portion 22 in a generally transverse relationship to the longitudinal axis 32 of the body 16. The rearward portion 20 of the body 16 further including a pair of side tabs 38, 40. The side tabs 38, 40 are respectively connected to and extending forwardly from front edges 28*a*, 30*a* of the side wing sections 28, 30 and are spaced laterally from the opposite side edges 24, 26 of the central portion 22 of the body 16 to enable insertion of the side tabs 38, 40 through respective slots 42, 44 in the packaging insert 12, as seen in FIGS. 3 and 4.

The rearward portion 20 of the body 16 also includes a tail section 46 disposed between the side wing sections 28, 30. The tail section 46 includes a central tab 48 and a pair of notches 50, 52 defined in the rearward portion 20. The center tab 48 terminates in a rear edge 48*a* that is generally aligned with rear edges 28*b*, 30*b* on the side wing sections 28, 30. The notches 50, 52 are located at or adjacent to opposite lateral sides 48*b*, 48*c* of the center tab 48 so as to separate the center tab 48 from the side wing sections 28, 30 to enable insertion of the center tab 48 through another slot 54 in the packaging fabric insert 12. With the side tabs 38, 40 and the center tab 48 respectively inserted through the slots 42, 44 and 54 the rearward portion 20 of the body 16 is provided in a threaded or interlaced relationship with the packaging fabric insert 12 so as to detachably attach the rearward portion 20 to the insert 12.

The forward portion 18 of the body 16 includes a head 56 connected with the central portion 22 of the body 16 and rear segments 58, 60 thereof connected with and extend laterally in opposite directions with respect to one another from the opposite side edges 24, 26 of the central portion 22 of the body 16. Also, a pair of slits 62, 64 are formed in the rear segments 58, 60 of the head 56 so as to open at respective rear edges 58*a*, 60*a* of the rear segments 58, 60 adjacent to the opposite side edges 24, 26 of the central portion 22 of the body 16. The slits 62, 64 enable fitting one portion, such as a handle 66, of the toner cartridge 68 of the device 14 through the slits 62, 64 and thereby anchoring the head 56 of the forward portion 18 of the body 16 to the handle 66 so as to thereby constraint the fabric insert 12 to a position clear of another portion, such as the photoconductor drum (not shown) located nearby the cartridge 68.

Thus, the rearward portion 20 of the body 16 includes multiple sections 28, 30 and 40 extending laterally beyond the opposite side edges 24, 26 of the central portion 22 and rearwardly from the central portion 22 which are configured with side and center tabs 38, 40 and 48 to detachably attach the rearward portion 20 of the body 16 to the packaging insert 12 by threading or interlacing the tabs 38, 40, 48 with the slots 42, 44, 54 in the packaging insert 12. The forward portion 18 of the body 16 is configured to anchor or hook the body 16 to one portion of the device 14 so as to thereby constrain the packaging insert 12 to a position clear of another portion of the device 14 located nearby the packaging insert 12. The hanger 10 holds the packaging insert 12 taut and away from the photoconductor drum, while providing easy and ready access to the end-user for removal.

The opposite side edges 24, 26 of the central portion 22 of the body 16 converge toward one another going from the rearward portion 20 to the forward portion 18 thereof so as to provide the central portion 22 with a tapered configuration. The head 56 on the forward portion 18 of the body 16 has an arrowhead configuration which together with the tapered configuration of the central portion 22 of the body 16 indicate to an end-user the direction in which the hanger 10 should be pulled for removal prior to installation. Also, an adhesive strip 70, as seen in FIG. 5, can be applied across the exposed side tabs 38, 40 and center tab 48 of the rearward portion 20 of the body 18 when they are in the threaded relationship with the packaging insert 12 so as to reinforce or further secure the detachable attachment of the rearward portion 20 of the body 16 to the packaging insert 12. Also, a window 72 can be cut into the fabric insert 12 above the center slot 54 to allow exposure of additional surface area of the hanger 10 to which the adhesive strip 70 can adhere.

As seen in FIG. 6, the separator hanger 10 in hooking onto the handle 66 of the toner cartridge 68 constitutes a mechanical lock-out feature which will not allow installation of the cartridge 68 into the device 14 unless the packaging fabric insert 12 is removed. The separator hanger 10 blocks the path of the cartridge 68 into the device 14 so that even if the end-user neglects to remove the insert 12, the cartridge 68 cannot be installed with the insert 12 thereon. A fool-proof way is thus provided to prevent the toner cartridge 68 from being used while the insert 12 is still installed.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A separator hanger, comprising:

a body having a forward portion and a rearward portion;

said rearward portion including at least one tab extending therefrom for interlocking with a respective slot in a packaging insert; and said forward portion including a head having an anchoring feature for attaching said body to one portion of a device to thereby constrain the packaging insert to a position clear of another portion of the device located nearby the packaging insert.

2. The separator hanger of claim 1, wherein said anchoring feature includes a pair of slits open at a rear edge of said forward portion for receiving said one portion of said device through said slits to anchor said head to said one portion of said device.

3. The separator hanger of claim 1, wherein said rearward portion includes a pair of forward extending tabs.

4. The separator hanger of claim 3, wherein said rearward portion includes a rearward extending tab positioned between said pair of forward extending tabs.

5. A separator hanger, comprising:

a body having a forward portion and a rearward portion;

said rearward portion including:

a pair of forward extending tabs for interlocking with a corresponding pair of slots in a packaging insert; and a rearward extending tab positioned between said pair of forward extending tabs for interlocking with a corresponding additional slot in said packaging insert.

* * * * *